US005111249A

United States Patent [19]

Owada

[11] Patent Number: 5,111,249

[45] Date of Patent: May 5, 1992

[54] HEAT ROLLER FIXING DEVICE

[75] Inventor: Akihiro Owada, Tokyo, Japan

[73] Assignee: Konica Corporation, Tokyo, Japan

[21] Appl. No.: 592,311

[22] Filed: Oct. 3, 1990

[30] Foreign Application Priority Data

Oct. 6, 1989 [JP] Japan ..... 1-261739

[51] Int. Cl.[5] ..... G03G 15/20

[52] U.S. Cl. ..... 355/285; 355/204; 355/290; 355/295

[58] Field of Search ..... 355/290, 295, 206, 285, 355/289, 282, 316, 313, 314, 204; 219/216

[56] References Cited

U.S. PATENT DOCUMENTS 4,595,274 6/1986 Sakurai ..... 355/
4,920,250 4/1990 Urban ..... 219/216

FOREIGN PATENT DOCUMENTS 0039643 3/1979 Japan ..... 355/290
0109382 8/1981 Japan ..... 355/290
0052667 3/1983 Japan ..... 355/290
0191277 9/1985 Japan ..... 355/285
0187364 8/1987 Japan ..... 355/285
0100583 4/1989 Japan ..... 355/285

*Primary Examiner*—A. T. Grimley
*Assistant Examiner*—Matthew S. Smith
*Attorney, Agent, or Firm*—Finnegan, Henderson, Farabow, Garrett and Dunner

[57] ABSTRACT

A fixing device for use in a copying machine for fixing a toner image on the surface of a recording sheet. The fixing device conveys the recording sheet between a pair of rollers consisting of a heating roller and a pressure roller to fix the toner image on the surface of the recording sheet by heating the toner image with the heating roller. After a number of recording sheets have been fixed as a batch, the pair of rollers separate from each other and stop rotating if the batch of recording sheets are smaller in number than a predetermined number, whereas the pair of rollers continue rotating in press contact with each other for a predetermined time interval after the batch of recording sheets have been fixed if the batch of recording sheets are larger in number than the predetermined number.

3 Claims, 3 Drawing Sheets

HEAT ROLLER FIXING DEVICE

BACKGROUND OF THE INVENTION

The present invention relates to a heat roller fixing device that is used in an image recording apparatus such as an electrophotographic copying machine for the purpose of fixing toner images formed on a recording paper.

In an electrophotographic copying machine or the like, toner images are formed on an electrophotographic photoreceptor and then the toner images thus formed are transferred onto a recording paper so that they adhere thereon electrostatically, and then are fixed by a heat roller fixing device onto the recording paper which is then ejected out of the copying machine.

A heat roller fixing device is composed of a heat roller having therein a built-in heater thereby controlling and keeping the surface of the roller at the temperature optimum for fusing and fixing toners and of a pressure roller that contacts the heat roller with pressure. The pressure roller is equipped, on its surface or in the vicinity of its surface, with an elastic layer such as a rubber layer or the like, and thereby a nip portion is formed between the heat roller and the pressure roller which are in contact with pressure (a nip portion is an area where both rollers contact each other). Fixing of toners on a recording paper is mainly carried out while the recording paper passes through the nip portion. Both FIG. 4 (*a*) and FIG. 4 (*b*) show nip portion N formed between heat roller 11 and pressure roller 12 which are in pressure-contact. As shown in FIG. 4 (*b*), shapes of rollers are usually determined so that nip width $N_A$ at the central portion of the roller is slightly smaller than that $N_B$ in the vicinity of each end portion of the roller. When a recording paper is nipped between the heating roller and the pressure roller to be transported and fixed therewith, such forces as shown by arrows in the FIG. 4(*b*) are exerted on the recording paper by the rollers due to an hourglass-shaped nip portion shown as a hatched area, and these forces are summed up to form a pair of tensile forces in lateral direction of the recording paper in addition to conveying force. The heat roller and the pressure roller of the fixing device are generally shaped in such forms as to generate the aforesaid pair of tensile forces for the purpose of preventing the recording paper from being creased during fixing and ejection processes.

In the heat roller fixing device stated above, heat roller 11 is generally arranged to rotate only for the period of fixing, and in a heat roller fixing device of a certain type, pressure roller 12 is always in contact with heat roller 11, while in that of other type, pressure roller 12 contacts only for the period of fixing. However, both of them, regardless of their types, have had following the disadvantages.

Namely, in a copying machine provided with an automatic document feeder (ADF), for example, when plural sets of copies need to be made for multiple documents, same size copies in the quantity of 100 sheets or more are sometimes made continuously. Immediately after the completion of such continuous copying for the multiple sheets of the same size, copying on the recording paper that is larger in size than the previous one is newly needed frequently. In such a case, copied images are sometimes disturbed, resulting in defective fixed copied images.

SUMMARY OF THE INVENTION

An object of the invention is to provide a heat roller fixing device that is controlled so that quality copied images may be obtained without being disturbed in terms of copied images even when such copies are made newly immediately after fixing for a large number of sheets of recording papers that is caused by copying under the usage of an automatic document feeder or by continuous copying for the same document.

Aforesaid object is attained by a heat roller fixing device comprising a rotating heat roller and a pressure roller that contacts the rotating heat roller with pressure, both rollers sandwiching a recording paper and transporting it for fixing, wherein both rollers keep rotating for a certain period of time while they are in pressure-contact when the product of the number of documents and the number of copies per document exceeds the number of copies set in the case when an automatic document feeder is used or when the number of recording papers to be fixed for the continuous copying for the same document exceeds the number of copies set in the case when no automatic document feeder is used.

DETAILED DESCRIPTION OF THE INVENTION

The inventors of the invention studied a phenomenon of deterioration of the quality of copied images made after continuous copying for multiple sheets of copies. Judging from the fact that the deterioration of the quality of copied images is notable especially on the larger size copies made after continuous copying for multiple sheets of copies in a smaller size, the inventor of the invention has clarified the cause of the deterioration of the quality of copied images to be the change in aforesaid shape of the nip made by continuous copying for multiple sheets of copies.

Figure 3:
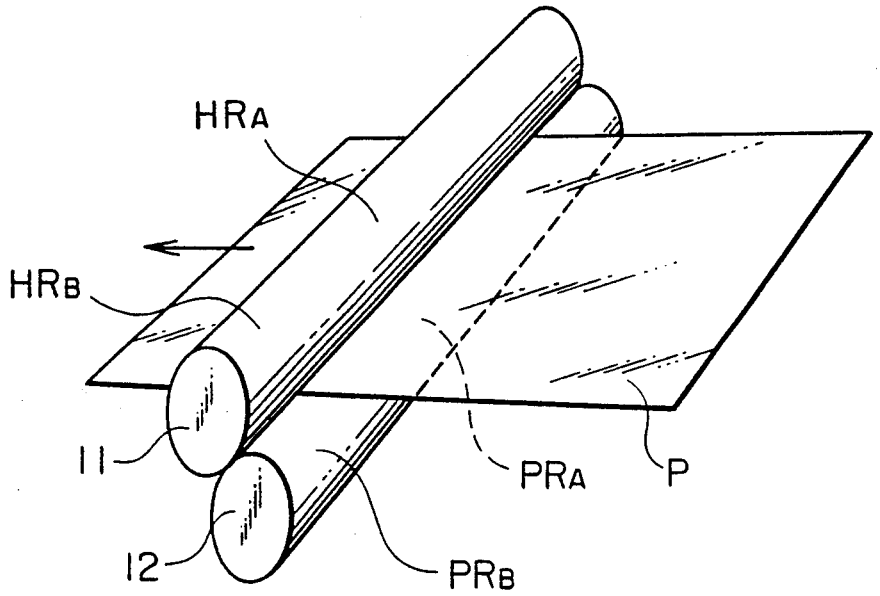
FIG. 3 is an illustration showing how a recording paper is sandwiched between a heat roller and a pressure roller.
Figure 4A:
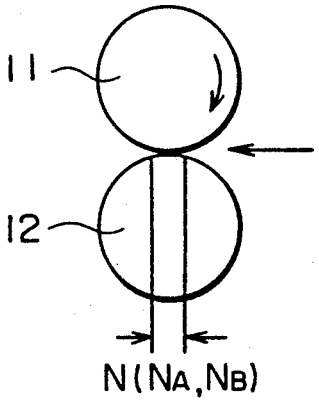
FIGS. 4 (*a*) and (*b*) represent an illustration of a nip portion formed by the pressure-contact between a heat roller and a pressure roller.
Figure 4B:
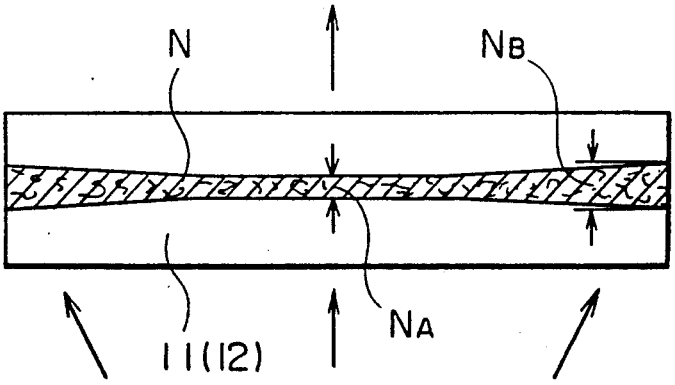

This is illustrated in FIG. 3. Namely, heat roller 11 and pressure roller 12 are in pressure-contact each other, and between them, multiple sheets of smaller size recording paper P pass through continuously. Since recording paper P absorbs heat from the rollers while it passes through the rollers, the temperature at the central portion of the roller where recording paper P passes is different, after the continuous copying for multiple sheets of copies, from that at the end portion of the roller where recording paper P does not pass through. An example of the difference between the temperature on the roller before the continuous copying for 100 sheets of recording papers and that on the roller immediately after the continuous copying is shown as follows. Incidentally, the pressure roller used in this case is 468 mm in length and 60 mm in diameter.

| | Central portion | End portion | Temperature difference |
|---|---|---|---|
| | (Before continuous copying) | | |
| Heat roller 11 | 196° T($HR_A$) | 192° T($HR_B$) | 4° |
| Pressure roller 12 | 104° T($PR_A$) | 100° T($PR_B$) | 4° |
| | (Immediately after continuous copying) | | |
| Heat roller 11 | 163° T($HR_A$) | 179° T($HR_B$) | 16° |
| Pressure roller 12 | 85° T($PR_A$) | 156° T($PR_B$) | 71° |

Variation of temperature on the roller causes the roller diameter to change. The big difference in temperature between the central portion and the end portion of the roller has an influence on the shape of a nip portion, and the value of $(N_B-N_A)$ resulting after the continuous copying is larger than that before the continuous copying. It has been regarded desirable from the past experience that the value of $(N_B-N_A)$ before the continuous copying is set to be 1 mm. It was clarified, however, that when the shape of a nip is changed to one satisfying an inequality of $(N_B-N_A)>S$ (e.g., S is 2 mm as an experimental value in the case of a roller whose diameter is 60 mmϕ), the component force that pulls the large-sized recording paper being in process of fixing and transport to its both sides becomes too great, resulting in disturbed copied images.

Further, the inventor of the invention, paying his attention to the fact that pressure roller 12 has a greater difference between the temperature at the central portion and that at the end portion of the roller, has found out that the effective way to eliminate quickly the difference between the temperature at the central portion and that at the end portion of pressure roller 12 is to cause pressure roller 12 to continue its pressure-contact with heat roller 11 and its rotation for a certain period of time after the continuous copying and thereby to raise the temperature at the central portion to lessen the temperature difference.

Figure 1:
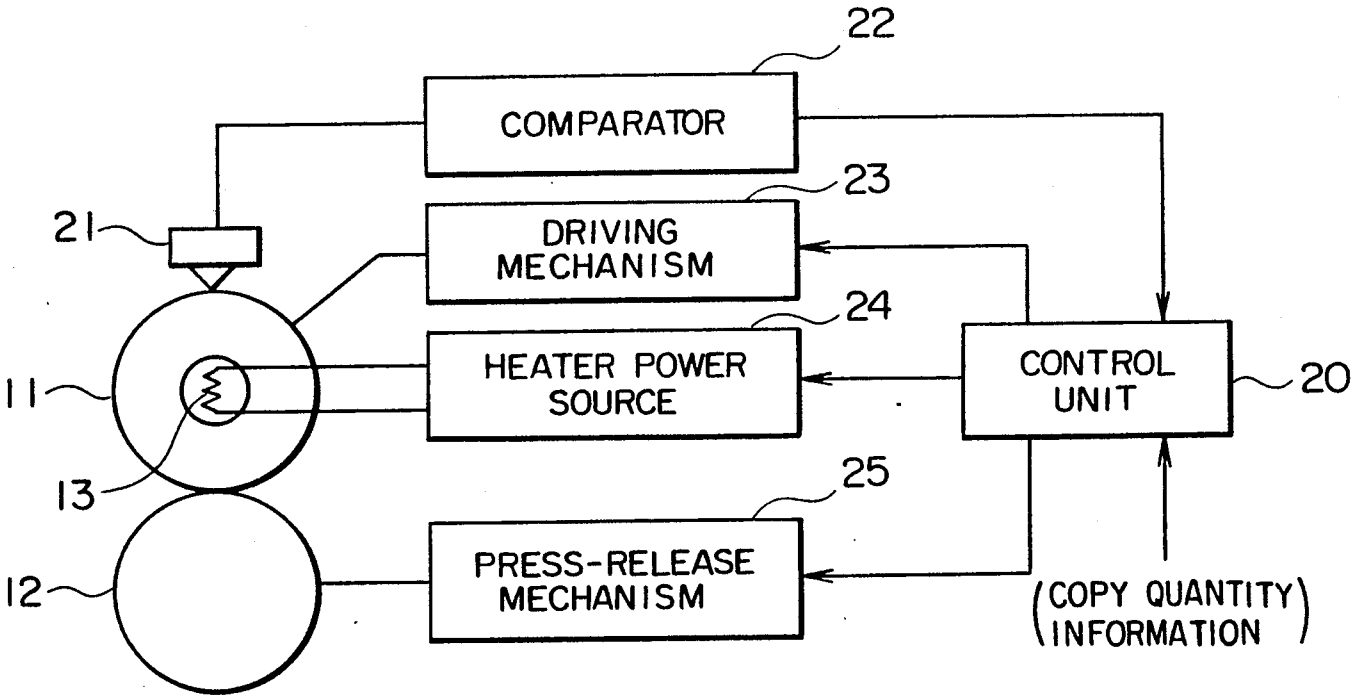
FIG. 1 represents a block flow diagram for a heat roller fixing device of the invention.

FIG. 1 is a block flow diagram of a heat roller fixing device of the invention. Pressure roller 12 to be explained here is for a heat roller fixing device wherein pressure roller 12 is in pressure-contact with heat roller 11 during the period of copying and is released from pressure-contact upon completion of copying, but it can also be applied similarly to a heat roller fixing device wherein pressure roller 12 is in pressure-contact constantly.

There is provided heater 13 such as an infrared lamp or the like in heat roller 11 so that heat roller 11 is heated from its core by heater power source 24 that is controlled by control unit 20. Temperature sensor 21 is provided on the circumference surface at the central portion of heat roller 11 in a manner that temperature sensor 21 is in contact with or is extremely close to the circumference surface so that temperature sensor 21 may detect the temperature on the surface of heat roller 11. The temperature on the surface of heat roller 11 thus detected is compared with the stipulated temperature by means of comparator 22. Based on the result of the comparison, control unit 20 turns on or turns off aforesaid heater power source 24 thereby to keep the surface of heat roller 11 to be constantly in the temperature condition suitable for fixing.

When a copy button on an apparatus is pressed, control unit 20 controls driving mechanism 23 for rotation to cause heat roller 11 to start rotating. Control unit 20, on the other hand, controls through pressure-contact and release mechanism 25 before a recording paper passes so that pressure roller 12 contacts heat roller 11 with pressure, and further controls so that the pressure-contact of pressure roller 12 may be released after the number of recording papers set in advance have passed and the rotation of heat roller 11 may be stopped.

In the invention, aforesaid control is made for copying of a number of copies less than a predetermined number, and when a large amount of copies are made continuously, different control is made. Namely, control unit 20 is provided with both a counting function and a memory function, and it controls, when continuous copying for the number of copies greater than the copy quantity set in advance is detected, so that the conditions for the continuous copying may be continued for a certain period of time even after the continuous copying is completed.

In case of a copying machine employing ADF, a copying operation is started when a copy button is pressed after documents are set in ADF and after the copy quantity is inputted. While copies are being made, a paper-ejection sensor provided in the vicinity of a paper-ejection outlet, for example, sends to control unit 20 information of passage of recording papers. Control unit 20 counts the number of passed recording papers. At the point of completion of copying, the copy quantity inputted into control unit 20 in advance (100 copies in the present example) is compared with the number of passed recording papers, and when the number of passed recording papers is smaller than the inputted copy quantity, control unit 20 causes heat roller 11 to stop rotating and pressure-contact of pressure roller 12 is released.

When the number of passed recording papers is greater than the inputted copy quantity at the point of completion of copying, control unit 20 keeps the condition for the copying for a predetermined period of time (20 sec in the present example) and control unit 20, after the predetermined period of time, causes heat roller 11 to stop rotating and releases pressure-contact of pressure roller 12.

Control unit 20 can arithmetically determine the number of recording sheets in one batch by multiplying the required number of copy sets by the number of document sheets in each set. In this manner, the total number of sheets to be recorded in the machine using ADF is determined.

When ADF is not used, continuous copying is started by pressing a copy button after inputting copy quantity for the set document by means of a ten-key or the like. In this case, again, a control unit compares the number of passed recording papers based on information from a paper-ejection sensor with the copy quantity set in advance, similarly to the previous case, and thereby controls the operation of heat roller 11 and pressure roller 12 in the same manner as in the foregoing. In this case, there may be available another arrangement wherein control unit 20 compares inputted information through aforesaid ten-key or the like, instead of information of the number of recording papers coming from a paper-ejection sensor, with aforesaid copy quantity set in advance.

Figure 2A:
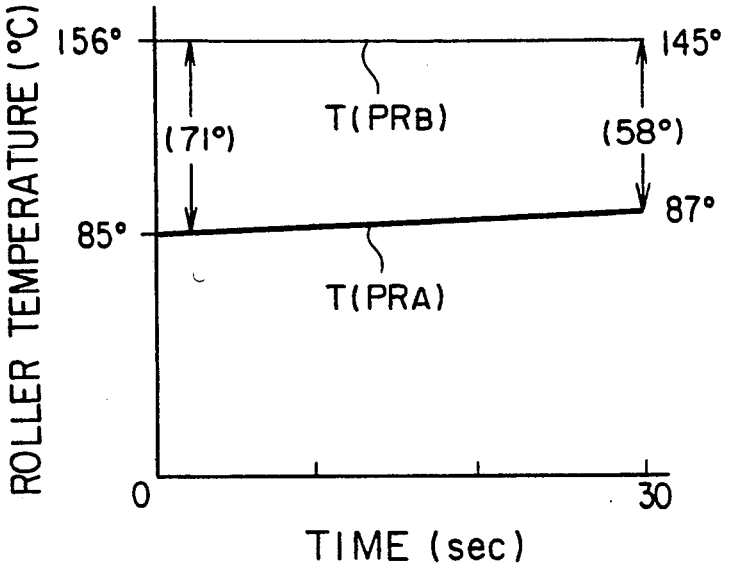
FIGS. 2 (*a*) and (*b*) represent graphs showing the temperature variation on a pressure roller, and FIG. 2 (*a*) represents an occasion of neither rotation nor pressure-contact while FIG. 2 (*b*) represents an occasion of rotation with pressure-contact.
Figure 2B:
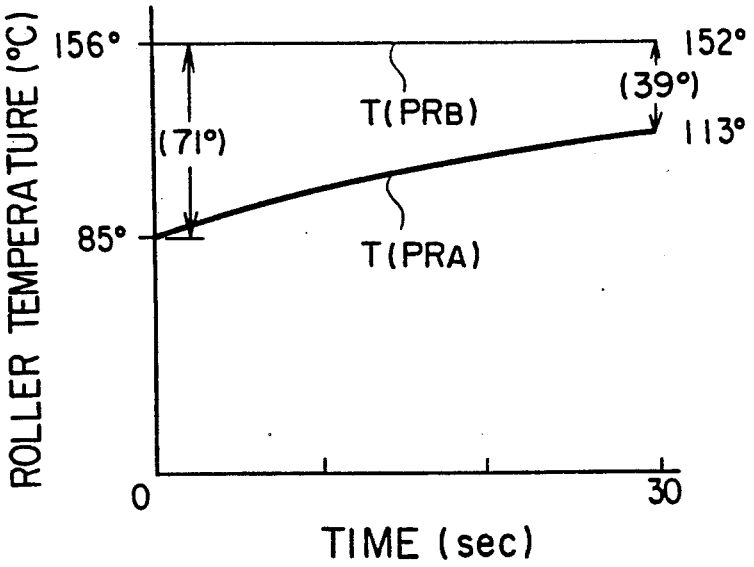

Both FIG. 2 (*a*) and FIG. 2 (*b*) represent the results of comparative tests showing an effect of the present example. At the point of completion of continuous copying for 100 copies, temperature T ($PR_A$) at $PR_A$ in the vicinity of the central portion of pressure roller 12 is 156° C. and temperature T ($PR_B$) at the end portion $PR_B$ is 85° C., resulting in the temperature difference of 71° C. between central portion $PR_A$ and end portion $PR_B$. FIG. 2 (*a*) shows the temperature change after continuous copying under the condition that pressure roller 12 does not contact heat roller 11 with pressure and does not rotate, and the temperature difference between central portion $PR_A$ and end portion $PR_B$ after 30 sec is still as high as 58° C. FIG. 2 (*b*), on the other hand, shows the temperature change under the condition that pressure roller 12 continues to be in pressure-contact with heat roller 11 and rotates even after continuous copying is completed. After 30 sec in this case, temperature T ($PR_B$) at central portion $PR_A$ is 152° C., while temperature T ($PR_B$) at end portion $PR_B$ rises up to 113° C., resulting in the temperature difference that is as low as 39° C.

In the present example wherein pressure roller 12 is caused to be in pressure-contact and to rotate for 20 sec after the completion of continuous copying for multiple sheets of 100 copies or more and then the pressure-contact is released, the larger size copies made newly after the 20 sec period showed no disturbed image. On the other hand, when pressure roller 12 was not caused to be in pressure-contact and thereby was not rotated after the completion of continuous copying, some of the copies made newly after the 20 sec period showed disturbed images.

The problems of disturbed copied images produced after the continuous copying for multiple copies have been solved by the invention which provides a heat roller fixing device capable of offering stable and excellent copied images even after performing continuous copying for multiple copies.

What is claimed is:

1. A thermal fixing device of a copying machine for fixing a toner image on the surface of a recording sheet, the device having a pair of rollers consisting of a heating roller and a pressure roller which convey the recording sheets therebetween, thereby heating and pressing the toner image to be fixed on the surface of the recording sheet, the device comprising:

means for driving at least one of the pair of rollers to rotate; and means for controlling the driving means to stop the rotation of the rollers when a number of sheets in a batch of recording sheets less than a predetermined number have been fixed and conveyed, and controlling the driving means to continue the rotation of the rollers for a predetermined interval after a number of sheets in a batch of recording sheets greater than the predetermined number have been fixed and conveyed.

2. The thermal fixing device of claim 1, further comprising:

means, controlled by the control means, for shifting the pressure roller towards pressure contact with the heating roller and away from the heating roller to separate the pair of rollers.

3. The thermal fixing device of claim 1, wherein the controlling means comprises:

arithmetic means including means for determining the number of recording sheets in a batch by multiplying a required number of copy sets and a number of document sheets having been copied when the copy machine is provided with an automatic document feeder, and including means for determining the number of recording sheets by counting up the recording sheets having been exhausted after copying and fixing when the copying machine is not provided with the automatic document feeder.

* * * * *